United States Patent [19]

Decaro

[11] 4,192,459

[45] Mar. 11, 1980

[54] RAIL ANCHORING SYSTEM

[75] Inventor: Charles J. Decaro, Marshfield, Mass.

[73] Assignee: Textron Inc., Providence, R.I.

[21] Appl. No.: 958,746

[22] Filed: Nov. 8, 1978

[51] Int. Cl.[2] ..... F01B 9/30

[52] U.S. Cl. ..... 238/356; 238/310; 238/357

[58] Field of Search ..... 238/355–359, 238/310, 321, 323

[56] References Cited

U.S. PATENT DOCUMENTS

| | | | |
|---|---|---|---|
| 570,003 | 10/1896 | Cook et al. | 238/356 |
| 1,122,573 | 12/1914 | Blessing | 238/356 |
| 1,628,550 | 5/1927 | Meredith et al. | 238/357 |

*Primary Examiner*—Robert R. Song
*Assistant Examiner*—Ross Weaver
*Attorney, Agent, or Firm*—Webb, Burden, Robinson & Webb

[57] ABSTRACT

The rail anchor system includes two pins and two clips. Each pin extends through a horizontal transverse bore in a cross-tie. The pins have extensions at each end exposed on both sides of the cross-tie and the bores are parallel to and substantially within the outer edges of the bottom flange of the rail which sits on the cross-tie. Two resilient clips form a part of the system. Each clip has a looped section, a hooked extension extending from one end of the looped section and a lever extension extending from the other end of the loop section. A clip is used on each side of the tie with the loop sections engaging the pin extensions of opposite pins and the lever extensions being locked by opposite pins when the respective hooks are in engagement with the cross-tie.

13 Claims, 8 Drawing Figures

RAIL ANCHORING SYSTEM

BACKGROUND

This invention relates to the art of fixing or anchoring rails to cross-ties, sleepers or the like.

Rails have traditionally been secured to wooden cross-ties by spikes vertically driven into the tie (today usually into predrilled holes). In recent years, numerous anchoring schemes have been developed which do not rely upon spikes, thus eliminating the vertical opening into the wooden tie. Various other anchoring schemes further enable the use of concrete or steel cross-ties or other understructures into which spikes cannot be driven.

The prior art is replete with proposals. Kelly U.S. Pat. No. 995,541 discloses a steel railway tie with a transverse bolt through the tie generally under the rail and a pair of rigid hook arms for engaging the bolt and the rail flange. The transverse bolt and hook arms cannot be placed until the rail has been set on top of the tie. Only then can the hook arms be slipped over the transverse bolt and tightened in place by turning a nut which is awkwardly positioned beneath the rail. Rigby U.S. Pat. No. 3,065,914 discloses two resilient U-shaped clips that are positioned in oblique holes in the sleeper and held merely by friction. Chapman U.S. Pat. No. 3,322,346 discloses clips designed to be driven into place holding the rail to a single tie bar beneath the center line of the rail. Hall U.S. Pat. No. 3,494,555 discloses two rigid holddown clamps journaled on a transverse rod. Installation requires mechanical or pneumatic tools or machines to exert a significant downward thrust against the pressure plate resting on the rail flange. Novotny U.S. Pat. No. 3,664,584 discloses clip fasteners that engage large protuberances of a specially configured sleeper. Belgian Pat. No. 515,661 discloses a clip that engages the extensions of a transverse rod passing not beneath the foot flange of the rail. One end engages the upper surface of the foot flange and the other end rests upon the top of the tie.

Any new anchoring system must, at least, provide as good or better anchoring than the prior art systems. The requirements for a rail anchoring system are not as simple as they might at first appear. The anchors must resist the lateral movement of the rail so that the gauge is maintained. The anchors should also restrain movement in the longitudinal direction of the rail. The anchors must further secure the rail from twisting along a horizontal axis especially on curves. Finally, the anchors must be designed to withstand vibration and pounding in the vertical direction as well as the movement in the above described horizontal directions. It is known that a rail is subject to an upward force as the vehicle truck approaches and a downward thrust as the wheels on the vehicle truck move thereover. The rail support structure including the anchors must be designed with sufficient flexibility to withstand vibration and pounding. Moreover, any new anchoring system should be at least as easy to install as traditional spikes in wooden rail systems. Preferably, an anchor should be capable of installation with hand tools as well as power means and not easily tampered with thereafter.

SUMMARY OF THE INVENTION

This invention relates to a rail anchoring system for securing a rail having a foot flange to cross-ties or the like. The anchoring system comprises two pins placed in separate, transverse, horizontal bores in the cross-tie. The bores are parallel to the rail, below and preferably within the outer edges of the bottom flange of the rail. In the case of the wooden ties, the bores are drilled. In the case of concrete ties, the bores may be formed by a mandrel during the casting process or may simply exist as a result of the placement of the pins themselves prior to casting. The pins have extensions at each end exposed on both sides of the cross-tie. Two resilient clips each comprise a hooked extension, a lever extension and a looped section therebetween. The loops of each clip are respectively pivoted upon pin extensions on different pins on opposite sides of the cross-tie. The hooked ends of the clips bear upon the upper and outer edge surfaces of the bottom flange of the rail. The lever extensions are wedged or sprung under an extension of the pin upon which the clip is not pivoted.

Preferably, the rail anchoring system comprises a clip in which the angle between the hooked and lever extensions near the loop after emplacement is 90° and 150°. Further it is preferred that the angle between the hooked and lever extensions near the loop be enlarged 7° to 14° when sprung in place with the capability of being enlarged 20° without exceeding the yield point of the material. It is preferable that the opening in the loop section of the clip is sufficiently larger than the diameter of the pin extension over which it is pivoted such that even after the pin has been sprung into position, the loop does not transfer a significant amount of torque to the pin.

In the rail anchoring system according to this invention each pin has a shank, a head configuration at one end to form the pivot means and a retaining means at the other end to engage the clip in the set condition. It is possible that the pin includes an adjustable means such as a cam surface so that during setting or after the clip is in place a turn of the adjusting means will cause a tightening of the clip by increasing the included angle between the hooked and lever extensions.

In a preferred embodiment according to this invention, the hooked extension of the clip is shorter than the distance between the transverse bores. The lever extension extends well beyond the particular pin extension upon which it is locked to provide a place where an extension pipe can be slipped over it for easy manual installation. The configuration of the clip and the pivot point location is selected to generate a maximum clamping force with a minimum lever arm.

It is an advantage of the anchoring system according to this invention that it is wear compensating. It is another advantage that the cross pins tend to prevent tie splitting in the clip area and wood cracking and deterioration will not affect the integrity of the anchoring system. It is a special advantage of this invention that the clips of the anchoring system may be preassembled on the pins prior to the laying of the rail and thereafter can be easily installed with hand tools. It is a further advantage that the clip according to this invention aids in controlling separation of the rail base from the tie plate thus assuring the specified gauge. It is yet another advantage according to this invention that the anchoring system may be adapted to accommodate any combination of standard AREA ties and rails. It is yet another advantage of this invention that the clip can be quickly released and replaced with appropriate hand tools by a knowledgeable person but are not easily tampered with.

Some of the aforestated advantages are particularly related to the use of wooden ties. However, it should be understood that the anchoring system disclosed herein is useful not only with wooden ties but has certain special advantages with sleepers other than wooden ties. For example, where the anchoring system is used with concrete sleepers that have a polymer tie plate between the rail and the concrete sleeper, the anchoring system minimizes the pulverizing action of the pounding rails upon the concrete ties.

THE DRAWINGS

DESCRIPTION OF THE PREFERRED EMBODIMENTS

Figure 1:
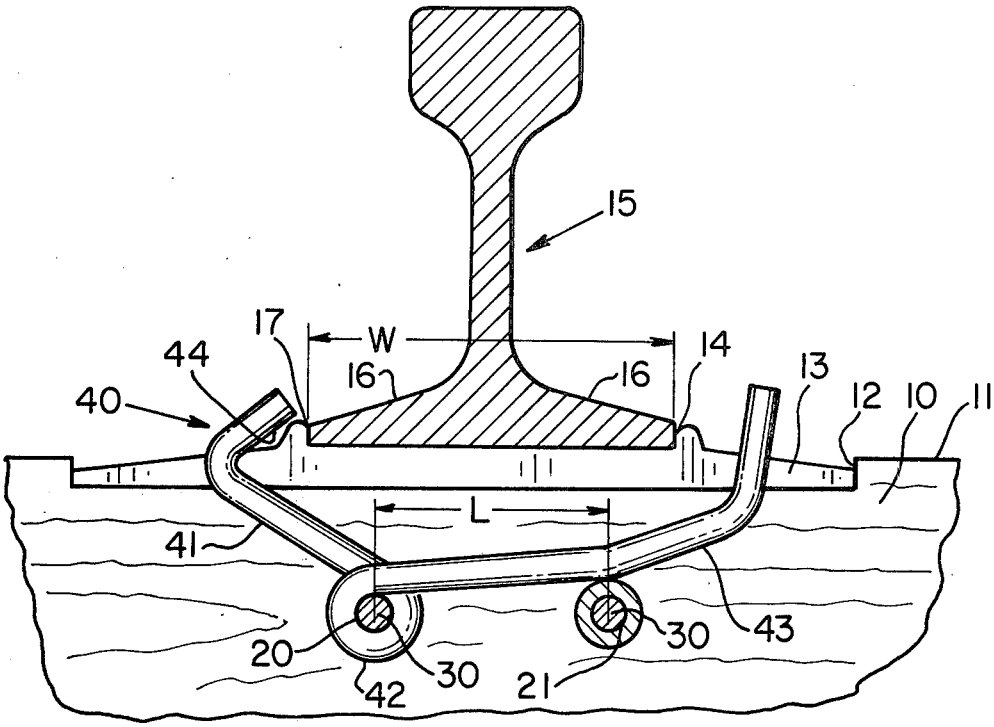
FIG. 1 is a view of the side of a tie and a section of the perpendicular rails illustrating the rail anchoring system according to this invention with the clip in the relaxed position.
Figure 2:
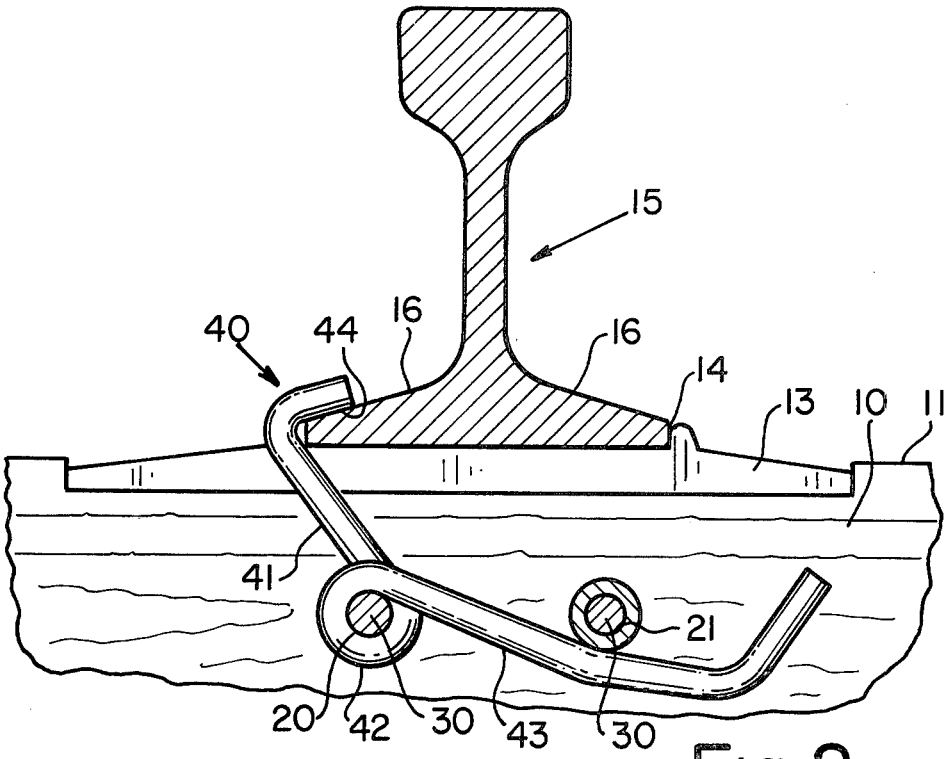
FIG. 2 is a view similar to that of FIG. 1 with the clip in the secured position.

Referring now to FIGS. 1 and 2, there is illustrated the rail anchoring system according to this invention. The cross-tie or sleeper 10 has an upper surface 11 in which is cut a transverse notch 12. Set within the notch is a rail seat or tie plate 13 (sometimes called a rail plate). The rail 15 shown as a typical I-beam rail having a foot flange 16 rests upon the tie plate 13. Since there are two rails associated with each tie, there are, of course, two notches and two tie plates associated with each tie. In the remainder of this description however, only one anchoring system per tie is described since the two anchoring systems associated with each tie are identical.

The tie plate 13 may be steel and shaped with an inner notch 14 which aids in maintaining the gauge (distance between rail pairs). The tie plate may comprise a plastic material such as polyethylene. This type of tie plate is beneficial in wood where the wood fibers may be cut by a metal plate.

According to the rail anchoring system disclosed herein, two holes 20 and 21 are bored entirely through the tie or sleeper transverse to the tie or sleeper and parallel to the rail. Typically, the holes 20 and 21 are drilled beneath the notch 14 near the center of the depth of the tie and equally spaced to each side of the center line of the rail. Preferably, the holes are positioned within the width W of the foot plate of the rail. In concrete sleepers the bores are formed during the casting process or by preplacement of the pin. The bores for concrete sleepers are positioned the same as for the wood ties.

A pin 30 is placed in each hole and extends through the tie 10 with exposed extensions on each end thereof. The pin must be provided with sufficient means to hold the pin fixedly within the holes with exposed extensions on each side of the tie. (The details of the presently preferred pins are described hereafter).

A uniquely configured clip 40 having a hooked extension 41, a looped section 42 and a lever extension 43 passes over and pivots upon the pin 20 as shown in FIG. 1. Clip 40 by its configuration is in the form of a torsion spring. Preferably, but not necessarily, the clip 40 is positioned on the pin extension before the rail 15 is placed on a tie plate. After the rail 15 is in place, the lever extension 43 of the clip 40 is pushed downwardly and outwardly from the side of the tie 10 and forced beneath the extension of the pin 21 upon which it is not pivoted as shown in FIG. 2. In this process, the hook extension 41 is rotated past the edge 17 of the foot flange 16 of the rail 15 so that surface 44 of the hook extension 41 engages the beveled upper surface 18 of the foot flange 16. Rotation can be effected by placing a setting tool, for example for manual setting a hollow pipe over the upwardly extending end of the lever extension 43 of the clip 40. The length of the pipe necessary to obtain leverage should be such that the yield of the torsion spring is not easily overcome to avoid tampering. The lever extension preferably has a bend at 45 to obtain a good mechanical advantage and which protrudes upward for convenience and limits the telescoping of the pipe over the extension.

The looped section 42 of the clip should have an opening in the loop which even after securement of the lever extension of the clip provides a reasonable fit so the clip can rotate upon the pin extension. Therefore both extensions 41 and 43 tend to be flexed by movement of the outer end of the hooked extension. Hence, flexing takes place in both extensions when the clip is installed and after it is installed the entire clip helps absorb the pounding forces transmitted from the train to the rails.

An upward force upon the hooked end of the clip tends to rotate the clip into tighter engagement with the face of the foot flange when the holes or bores for pins 30 are within the outer edge of the foot flange. The optimum clamping force is achieved when the clamp force of the hook extension is vertically above the particular pin acting as the pivot point. When this vertical alignment is achieved the mode of failure is dictated by the tensile strength of the clip. By maintaining the clamping force along surface 44 at or along a position in vertical alignment with the pin, the lever arm for calculating the moment remains quite small and the clamping ability is maximized.

Figure 3:
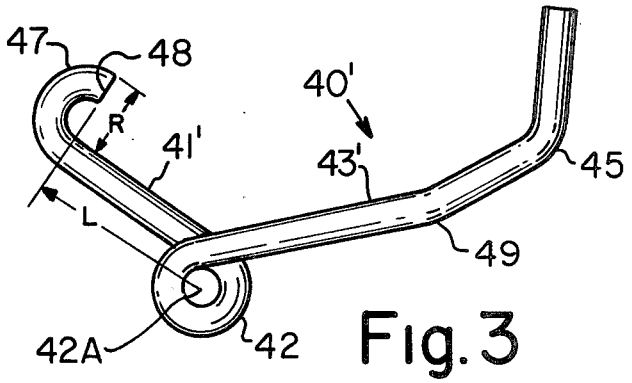
FIG. 3 illustrates relative dimensions of a modified clip useful in the rail anchoring system according to this invention.

Referring now to FIG. 3, there is shown a detailed view of a slightly modified clip 40'. The looped section 42' comprises a single wrap of about 310° around the pivot opening 42*a*. Additional wraps are permissable but apparently unnecessary. A portion of the loop section 42' comprises an overlap of the two extensions. The overlap is such that when the clip 40' is placed on a pin 30 the hooked extension 41' is closer to the tie than the lever extension 43'. Depending on the type of pin employed, this can be important as the lever extension must not only be pulled downwardly to enlarge the included angle between the extensions, but it must also be sprung outwardly away from the side of the tie to clear the extension of the pin upon which it is secured. With the overlap as shown in FIG. 3, the outward spring of the lever extension 43' does not interfere with the hooked extension 41'.

The diameter of the opening of the loop section 42' for the embodiment shown provides a clearance of about 5/32 inch over the diameter of the bar (0.50 inches) from which the clip is formed and the diameter of the pin over which it is pivoted (also 0.50 inches).

The hooked extension in this embodiment has a length L of about 3 inches terminating in a 180° bend defining a hook 47. The hook 47 enters the space defined by the included angle between the extensions 41' and 43'. In other words, the hook 47 turns toward the center line of the rail.

The hook terminates in a bearing face 48 which has an outer edge a distance R from the inner edge 41*e* of the hooked extension. The distance R in the illustrated embodiment is about 1½ inches. As can be seen bearing face 48 provides less surface area engagement as compared to surface 44 of the clip of FIGS. 1 and 2.

For both the clip embodiments illustrated, the included angle between the hooked extension and the lever extension near the looped section when in place is about 130°. The length of the lever extension between the pins L (see FIG. 1) is about 4 inches for the embodiment illustrated. The lever extension must extend beyond the distance L. The precise configuration and length of the levered extension beyond the distance L is optional. However, as explained in more detail hereinafter, the lever extension is below the surface of the tie after the clip has been secured in place. The lever extension should preferably provide two bends 45 and 49 along its length. In the embodiment illustrated the bend 45 is approximately 60° which with the smaller bend 49 of 15° places the distal end of the pin at 75° to the lever extension adjacent the loop section. In this way, the distal end extends upwardly after the rail is placed upon the rail plate thus simplifying the engagement of the lever pipe on the lever extension by workmen standing above the clip. This also provides the clearance for the pipe extension when it is pulled to expand the included angle between the sections during installation.

The length L' (FIG. 3) of the hooked arm 41' should be just long enough and the hook 47 configured so that when the clip is rotated upon the pin over which it is pivoted into the anchoring position, it passes just over the outer edge of foot flange of the rail and the inner edge can be brought to bear upon the edge of the foot flange and the surface 48 can be brought to bear on the usually beveled upper surface of the foot flange. Stated another way, for a given clip size the holes for the pin should be positioned sufficiently below the surface of the tie and inwardly of the edge of the foot flange (if need be) to permit the clip to rotate into the anchoring position described above. Furthermore, the holes for the pin should be positioned inwardly of the outer edge of the foot flange so that the center of bearing face 48 or 44 closest to the centerline of the rail is approximately vertically above the pin.

The clip is so dimensioned that during setting the included angle between the hook extension and the lever extension is increased from 7° to 20° and preferably from 7° to 14°. The minimum angle increase is dictated by the minimum clamping force required and the maximum angle increase is limited by the yield point of the material.

It is highly desirable that the clamping force be substantially uniform from clip to clip along the rail. By clamping force is meant both the horizontal and vertical components of the force the clip exerts upon the rail. An upward movement of the rail can cause two types of response in the clip. It can cause the elongation of the hooked extension or it can cause the rotation of the clip away from the engaging position. The action of the clip to prevent rotation can be controlled by assuring that the expansion of the included angle between the hooked extension and the lever extension is substantially uniform. This will result from the proper uniform positioning of the pins and the uniform manufacture of the clips.

According to a preferred embodiment, the clip is configured so that when the hooked extension just rests upon the rail flange the levered extension rests upon the top of the oposite pin extension. The included angle is increased by moving the lever extension from the upper to the lower sides of the opposite pin extension. Since this distance is uniform pin to pin, the increase in the included angle will be uniform. By observing whether or not the arms of the clip are actually in the correct positions adjacent the rail flange and opposite pin it is possible for those installing the clip to know at the time of installation if the pin locations are correct.

The steel used for the manufacture of the clip should be a spring steel, for example of the type 6140-50 (hardened and tempered). This steel along with other suitable steels for springs is described at pages 160 to 174 of *Metals Handbook,* Volume 1, 8th Ed. published by the American Society for Metals.

Figure 4:
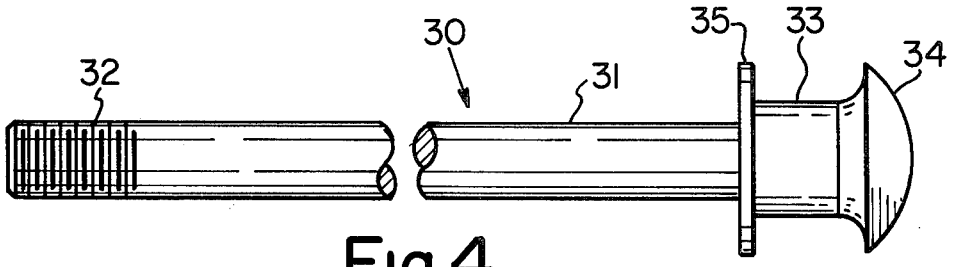
FIG. 4 illustrates a pin and associated washer.
Figure 5:
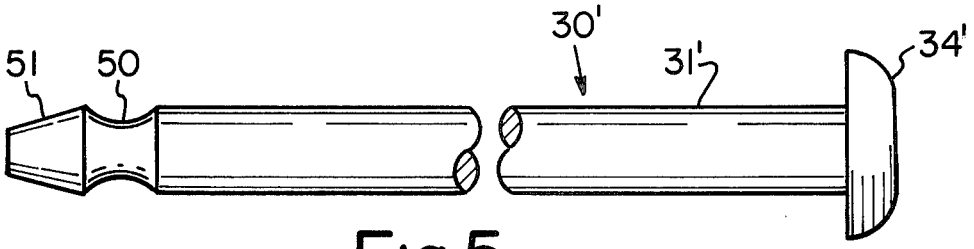
FIG. 5 illustrates another type of pin.

Referring now to FIGS. 4 and 5, there are shown two different types of pins 30 and 30' suitable for use in this invention. The pin 30 has a shank 31 which is threaded at one end 32 and has an enlarged section 33 and head 34 at the other end to give it a double headed configuration. The enlarged section permits the head to be set off from the tie. Preferably the radial face between the shank 31 and enlarged section 33 comprises a seat for washer 35. The space between the washer 35 and the head is the extension over which the loop section 43 of a clip 40 is pivoted.

It will be recognized that other forms of pins and retaining means can be employed. For example, the pin can take the form of a lock bolt and the retaining means can be a lock bolt collar.

Another type of pin 30' does not require an external retaining means, FIG. 5. Pin 30' includes a shank 31' which is dimensioned for a frictional fit within the bore in the tie. Shank 31' can be knurled or include other forms of surface disruptions to assure the friction fit and at the same time reinforce the tie to prevent splitting. Shank 31' terminates at one end in an enlarged head 34' and at the other end in an annular notch 50 and a tapered end section 51. The notch 50 retains the lever extension of the clip in the set condition. The tapered section 51 can be employed in the setting of the clip. The pin 30' can be initially installed in the tie so that only the tapered section or distal end thereof extends out of the tie. By having the lever extension engage the distal end and thereafter driving the pin by a blow to the head 34', the clip can be forced open through the desired deflection, e.g. 7° to 20°, to cause the setting of the clip.

Figure 6:
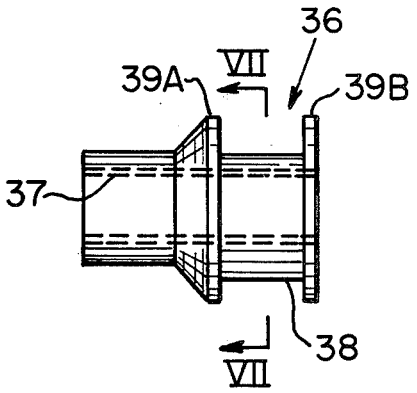
FIG. 6 illustrates a nut with an associated cam surface.
Figure 7:
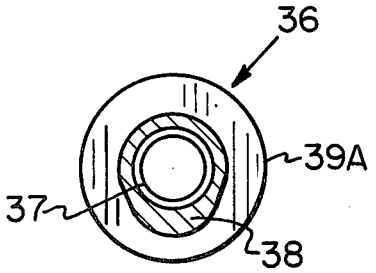
FIG. 7 is a section through the cam surface taken along lines VII—VII of FIG 6.

A special nut-cam combination 36 comprising a standard nut 37 with internal threads and a cam section 38 co-axial with the nut can be used in conjunction with pin 30 of FIG. 4, see FIGS. 6 and 7. The nut 36 comprises integral washers 39*a* and 39*b* at opposing axial ends of the cam 38. The space between the washers and cam surface 38 comprise the location which accommodates the lever end of a clip 40 after the clip is emplaced. A turn of the nut-cam 36 will place additional tension on the lever extension and the hooked extension. In this particular embodiment, the lever extension of the pin may be positioned below and adjacent to the cam 38 in the relaxed position. By then turning nut-cam 36, the degree of deflection and resultant clamp load is reproducibly achieved.

INSTALLATION

The tie may be predrilled and prenotched with two pairs of transverse pin holes prior to emplacement or in the case of cement sleepers the pins and notches may be preformed. Further the ties or sleepers may be preassembled with the pins and clips prior to placing on the track bed. On the other hand, the ties may be drilled and notched in place, that is after the ties are placed on the ballast. Where the notch in wooden ties is adzed after placement of the tie upon the ballast, the assembly of the pin and clip to the tie should be made prior to the laying of the rails but after the ties are placed upon the ballast. The pins and clips should be positioned in the tie prior to rail placement to provide adequate accessibility to the holes provided for the pins. The tie plate is placed in the notch provided therefore in the tie. The rails are then set within the notch in the tie plate. Thereafter the clip is rotated into a secure position on each pin extension or the pin may be driven as in the case of pin 30'.

Figure 8:
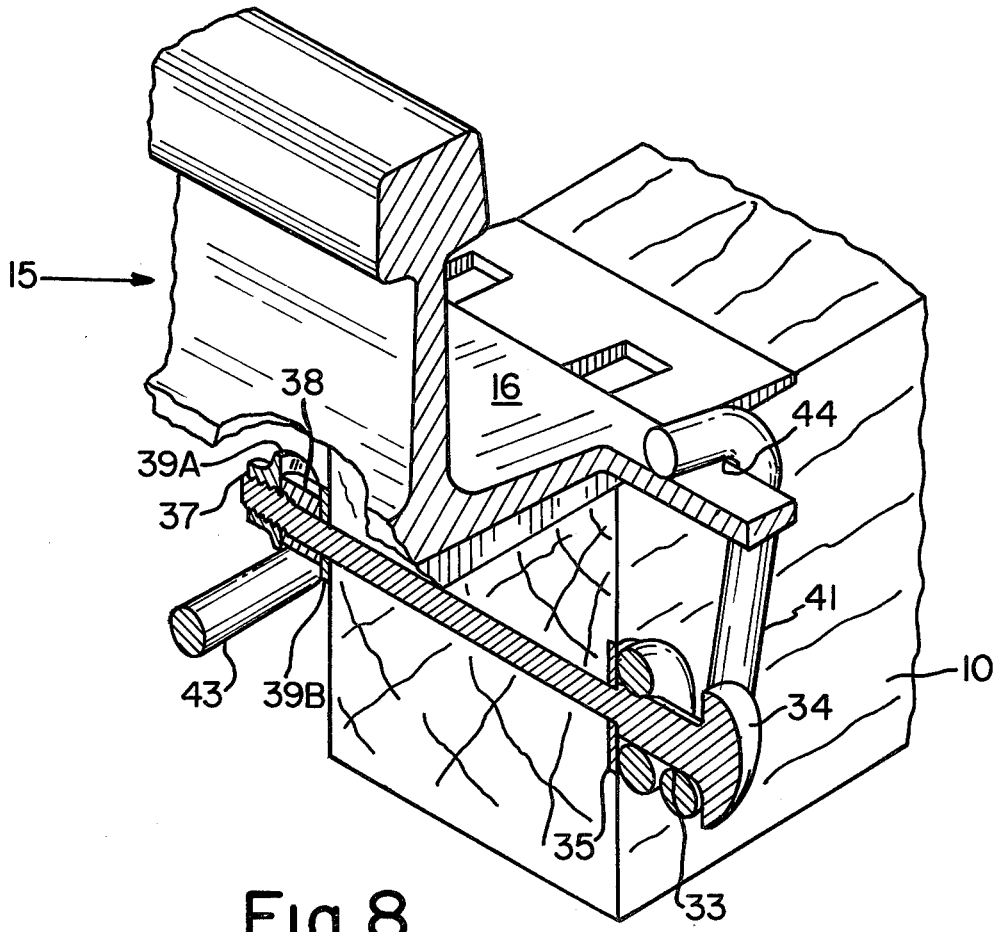
FIG. 8 is a sectional pictorial view illustrating both ends of a pair and two clips in a set condition.

FIG. 8 shows how a single pin acts as the pivot means at one end and the locking means at the other. This is true regardless of the type of pin employed, although in FIG. 8 the pin of FIG. 4 is shown with the nut cam of FIGS. 6 and 7.

Having thus defined my invention in the detail and particularity required by the Patent Laws, what is desired protected by Letters Patent is set forth in the following claims.

1. A rail anchoring system for securing a rail having a bottom flange to a cross-tie or the like comprising two pins, said pins placed in separate, transverse, horizontal bores in the cross-tie, said bores being parallel to the rail, said pins having extensions at each end exposed on both sides of the cross-tie, two resilient clips, each comprising a hooked extension, a looped section, and a lever extension, the said looped sections of said clips respectively passing over and pivoted upon the extension at one end of different pins on opposite sides of the cross-tie, the hooked ends bearing on the upper and outer edge surfaces of the bottom flange of the rail and the lever extensions being wedged under extensions of a pin upon which said clips are respectively not pivoted.

2. A rail anchoring system according to claim 1 wherein the bores are below and substantially within the outer edges of the bottom flange of the rail.

3. A rail anchoring system according to claim 1 wherein the angle between the hooked and lever extensions near the looped section after emplacement is between 90° and 150°.

4. A rail anchoring system according to claim 1 wherein the angle between the hooked and lever extensions near the looped section is between 7° and 20° and preferably 7° to 14° greater after emplacement than prior to emplacement.

5. A rail anchoring system according to claim 1 wherein the diameter of the opening in the looped section of the clip is sufficiently larger than the diameter of the pin extension over which it pivots such that even after the clip has been sprung into position, the looped section turns on the pin.

6. A rail anchoring system according to claim 1 wherein the pins have a shank, a double head on one end to ensure the extension out of the tie at that end, and threads on the other end.

7. A rail anchoring system according to claim 6 wherein a nut with an integral axially spaced cam surface is threaded upon the pin.

8. A rail anchoring system according to claim 1 wherein the clip is fabricated from a rod at least one half inch in diameter being spring steel.

9. A rail anchoring system according to claim 1 wherein the pins are positioned substantially vertically below the area where the end of the hook bears upon the upper surface of the foot flange of the rail.

10. A rail anchoring system according to claim 1 wherein the pins include a shank, a head at one end and retaining means at the other end for receiving and retaining the lever extension in a set condition.

11. The rail anchoring system according to claim 10 wherein the retaining means comprises an annular groove.

12. The anchoring system according to claim 11 wherein the retaining means further includes a tapered distal end adjacent the annular groove.

13. An anchoring system comprising:

A. a railroad tie;

B. a rail having a bottom flange positioned on and extending perpendicular to the tie, said tie including a pair of horizontal bores extending through the tie equidistant from the rail and substantially within outer edges of the bottom flange;

C. a first and second pin, each extending through one of said bores and having extensions at each end exposed on both sides of the tie;

D. two resilient torsion spring clips, each having a loop section of at least one coil, a first extension arm extending from the loop section in a first direction and terminating in a hook and a second extension arm extending from the loop section in an opposite direction and terminating in a locking arm the said loop section of one clip positioned on an extension of the first pin, said clip pivotable about the pin from a first position in which the hook is just out of engagement with the flange and the second extension arm is positioned substantially atop the second pin and a second position in which the hook engages the flange substantially vertically above the first pin and the locking arm is retained by and below the second pin said other clip positioned on an extension of the second pin and on opposite sides of the tie from the first clip and operable in the same manner as the first clip

* * * * *